US007165025B2

(12) United States Patent
Kim

(10) Patent No.: US 7,165,025 B2
(45) **Date of Patent: *Jan. 16, 2007**

(54) AUDITORY-ARTICULATORY ANALYSIS FOR SPEECH QUALITY ASSESSMENT

(75) Inventor: Doh-Suk Kim, Basking Ridge, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 862 days.

This patent is subject to a terminal disclaimer.

(21) Appl. No.: 10/186,840

(22) Filed: Jul. 1, 2002

(65) Prior Publication Data

US 2004/0002852 A1 Jan. 1, 2004

(51) Int. Cl.
*G10L 11/00* (2006.01)

(52) U.S. Cl. ..... 704/206; 704/200.1; 704/250

(58) Field of Classification Search ..... None
See application file for complete search history.

(56) References Cited

U.S. PATENT DOCUMENTS 3,971,034 A * 7/1976 Bell et al. ..... 346/33 R
5,313,556 A * 5/1994 Parra ..... 704/246
5,454,375 A * 10/1995 Rothenberg ..... 600/538
5,799,133 A * 8/1998 Hollier et al. ..... 706/25
6,035,270 A * 3/2000 Hollier et al. ..... 704/202
6,052,662 A * 4/2000 Hogden ..... 704/256.2
6,246,978 B1 * 6/2001 Hardy ..... 704/201
2004/0002857 A1 * 1/2004 Kim ..... 704/222
2004/0267523 A1 * 12/2004 Kim ..... 704/205

* cited by examiner

*Primary Examiner*—Donald L. Storm
(74) *Attorney, Agent, or Firm*—Jimmy Goo

(57) ABSTRACT

Auditory-articulatory analysis for use in speech quality assessment. Articulatory analysis is based on a comparison between powers associated with articulation and non-articulation frequency ranges of a speech signal. Neither source speech nor an estimate of the source speech is utilized in articulatory analysis. Articulatory analysis comprises the steps of comparing articulation power and non-articulation power of a speech signal, and assessing speech quality based on the comparison, wherein articulation and non-articulation powers are powers associated with articulation and non-articulation frequency ranges of the speech signal.

16 Claims, 2 Drawing Sheets

30

AUDITORY-ARTICULATORY ANALYSIS FOR SPEECH QUALITY ASSESSMENT

FIELD OF THE INVENTION

The present invention relates generally to communications systems and, in particular, to speech quality assessment.

BACKGROUND OF THE RELATED ART

Performance of a wireless communication system can be measured, among other things, in terms of speech quality. In the current art, subjective speech quality assessment is the most reliable and commonly accepted way for evaluating the quality of speech. In subjective speech quality assessment, human listeners are used to rate the speech quality of processed speech, wherein processed speech is a transmitted speech signal which has been processed, e.g., decoded, at the receiver. This technique is subjective because it is based on the perception of the individual human. However, subjective speech quality assessment is an expensive and time consuming technique because sufficiently large number of speech samples and listeners are necessary to obtain statistically reliable results.

Objective speech quality assessment is another technique for assessing speech quality. Unlike subjective speech quality assessment, objective speech quality assessment is not based on the perception of the individual human. Objective speech quality assessment may be one of two types. The first type of objective speech quality assessment is based on known source speech. In this first type of objective speech quality assessment, a mobile station transmits a speech signal derived, e.g., encoded, from known source speech. The transmitted speech signal is received, processed and subsequently recorded. The recorded processed speech signal is compared to the known source speech using well-known speech evaluation techniques, such as Perceptual Evaluation of Speech Quality (PESQ), to determine speech quality. If the source speech signal is not known or transmitted speech signal was not derived from known source speech, then this first type of objective speech quality assessment cannot be utilized.

The second type of objective speech quality assessment is not based on known source speech. Most embodiments of this second type of objective speech quality assessment involve estimating source speech from processed speech, and then comparing the estimated source speech to the processed speech using well-known speech evaluation techniques. However, as distortion in the processed speech increases, the quality of the estimated source speech degrades making these embodiments of the second type of objective speech quality assessment less reliable.

Therefore, there exists a need for an objective speech quality assessment technique that does not utilize known source speech or estimated source speech.

SUMMARY OF THE INVENTION

The present invention is an auditory-articulatory analysis technique for use in speech quality assessment. The articulatory analysis technique of the present invention is based on a comparison between powers associated with articulation and non-articulation frequency ranges of a speech signal. Neither source speech nor an estimate of the source speech is utilized in articulatory analysis. Articulatory analysis comprises the steps of comparing articulation power and non-articulation power of a speech signal, and assessing speech quality based on the comparison, wherein articulation and non-articulation powers are powers associated with articulation and non-articulation frequency ranges of the speech signal. In one embodiment, the comparison between articulation power and non-articulation power is a ratio, articulation power is the power associated with frequencies between 2~12.5 Hz, and non-articulation power is the power associated with frequencies greater than 12.5 Hz.

BRIEF DESCRIPTION OF THE DRAWINGS

The features, aspects, and advantages of the present invention will become better understood with regard to the following description, appended claims, and accompanying drawings where:

DETAILED DESCRIPTION

The present invention is an auditory-articulatory analysis technique for use in speech quality assessment. The articulatory analysis technique of the present invention is based on a comparison between powers associated with articulation and non-articulation frequency ranges of a speech signal. Neither source speech nor an estimate of the source speech is utilized in articulatory analysis. Articulatory analysis comprises the steps of comparing articulation power and non-articulation power of a speech signal, and assessing speech quality based on the comparison, wherein articulation and non-articulation powers are powers associated with articulation and non-articulation frequency ranges of the speech signal.

Figure 1:
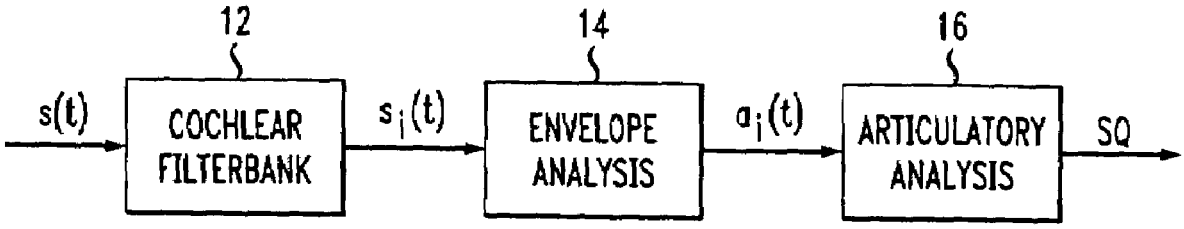
FIG. 1 depicts a speech quality assessment arrangement employing articulatory analysis in accordance with the present invention.

FIG. 1 depicts a speech quality assessment arrangement 10 employing articulatory analysis in accordance with the present invention. Speech quality assessment arrangement 10 comprises of cochlear filterbank 12, envelope analysis module 14 and articulatory analysis module 16. In speech quality assessment arrangement 10, speech signal s(t) is provided as input to cochlear filterbank 12. Cochlear filterbank 12 comprises a plurality of cochlear filters $h_i(t)$ for processing speech signal s(t) in accordance with a first stage of a peripheral auditory system, where $i=1,2, \ldots, N_c$ represents a particular cochlear filter channel and $N_c$ denotes the total number of cochlear filter channels. Specifically, cochlear filterbank 12 filters speech signal s(t) to produce a plurality of critical band signals $s_i(t)$, wherein critical band signal $s_i(t)$ is equal to $s(t)*h_i(t)$.

The plurality of critical band signals $s_i(t)$ is provided as input to envelope analysis module 14. In envelope analysis module 14, the plurality of critical band signals $s_i(t)$ is processed to obtain a plurality of envelopes $a_i(t)$, wherein $a_i(t)=\sqrt{s_1^2(t)+\hat{s}_i^2(t)}$ and $\hat{s}_i(t)$ is the Hilbert transform of $s_i(t)$.

The plurality of envelopes $a_i(t)$ is then provided as input to articulatory analysis module 16. In articulatory analysis module 16, the plurality of envelopes $a_i(t)$ is processed to obtain a speech quality assessment for speech signal s(t). Specifically, articulatory analysis module 16 does a comparison of the power associated with signals generated from the human articulatory system (hereinafter referred to as "articulation power $P_A(m,i)$") with the power associated with signals not generated from the human articulatory system (hereinafter referred to as "non-articulation power $P_{NA}(m,i)$"). Such comparison is then used to make a speech quality assessment.

Figure 2:
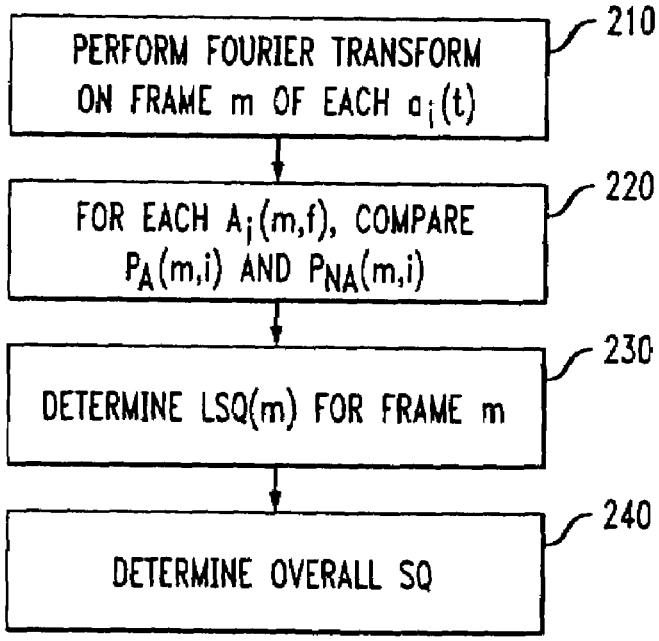
FIG. 2 depicts a flowchart for processing, in an articulatory analysis module, the plurality of envelopes $a_i(t)$ in accordance with one embodiment of the invention.

FIG. 2 depicts a flowchart 200 for processing, in articulatory analysis module 16, the plurality of envelopes $a_i(t)$ in accordance with one embodiment of the invention. In step 210, Fourier transform is performed on frame m of each of the plurality of envelopes $a_i(t)$ to produce modulation spectrums $A_i(m,f)$, where f is frequency.

Figure 3:
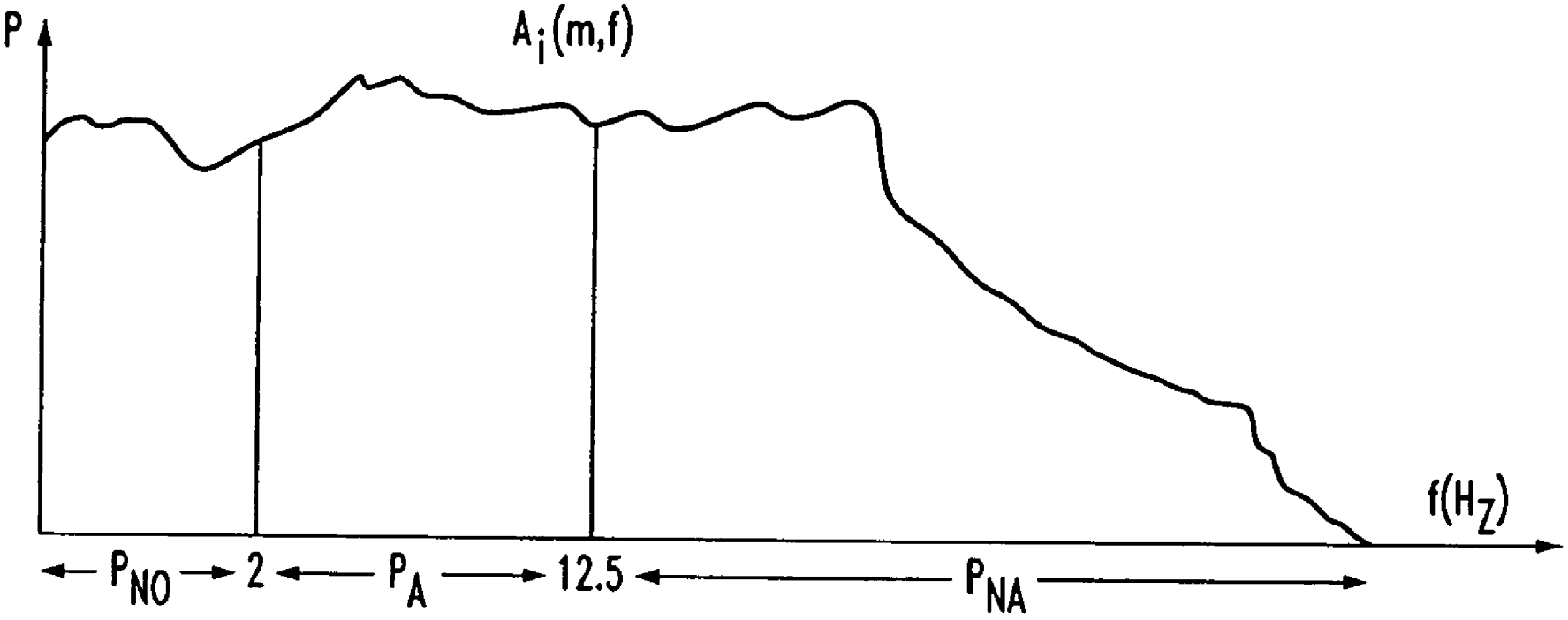
FIG. 3 depicts an example illustrating a modulation spectrum $A_i(m,f)$ in terms of power versus frequency.

FIG. 3 depicts an example 30 illustrating modulation spectrum $A_i(m,f)$ in terms of power versus frequency. In example 30, articulation power $P_A(m,i)$ is the power associated with frequencies 2~12.5 Hz, and non-articulation power $P_{NA}(m,i)$ is the power associated with frequencies greater than 12.5 Hz. Power $P_{No}(m,i)$ associated with frequencies less than 2 Hz is the DC-component of frame m of critical band signal $a_i(t)$. In this example, articulation power $P_A(m,i)$ is chosen as the power associated with frequencies 2~12.5 Hz based on the fact that the speed of human articulation is 2~12.5 Hz, and the frequency ranges associated with articulation power $P_A(m,i)$ and non-articulation power $P_{NA}(m,i)$ (hereinafter referred to respectively as "articulation frequency range" and "non-articulation frequency range") are adjacent, non-overlapping frequency ranges. It should be understood that, for purposes of this application, the term "articulation power $P_A(m,i)$" should not be limited to the frequency range of human articulation or the aforementioned frequency range 2~12.5 Hz. Likewise, the term "non-articulation power $P_{NA}(m,i)$" should not be limited to frequency ranges greater than the frequency range associated with articulation power $P_A(m,i)$. The non-articulation frequency range may or may not overlap with or be adjacent to the articulation frequency range. The non-articulation frequency range may also include frequencies less than the lowest frequency in the articulation frequency range, such as those associated with the DC-component of frame m of critical band signal $a_i(t)$.

In step 220, for each modulation spectrum $A_i(m,f)$, articulatory analysis module 16 performs a comparison between articulation power $P_A(m,i)$ and non-articulation power $P_{NA}(m,i)$. In this embodiment of articulatory analysis module 16, the comparison between articulation power $P_A(m,i)$ and non-articulation power $P_{NA}(m,i)$ is an articulation-to-non-articulation ratio ANR(m,i). The ANR is defined by the following equation $$ANR(m,i) = \frac{P_A(m,i)+\varepsilon}{P_{NA}(m,i)+\varepsilon} \qquad \text{equation (1)}$$

where $\epsilon$ is some small constant value. Other comparisons between articulation power $P_A(m,i)$ and non-articulation power $P_{NA}(m,i)$ are possible. For example, the comparison may be the reciprocal of equation (1), or the comparison may be a difference between articulation power $P_A(m,i)$ and non-articulation power $P_{NA}(m,i)$. For ease of discussion, the embodiment of articulatory analysis module 16 depicted by flowchart 200 will be discussed with respect to the comparison using ANR(m,i) of equation (1). This should not, however, be construed to limit the present invention in any manner.

In step 230, ANR(m,i) is used to determine local speech quality LSQ(m) for frame m. Local speech quality LSQ(m) is determined using an aggregate of the articulation-to-non-articulation ratio ANR(m,i) across all channels i and a weighing factor R(m,i) based on the DC-component power $P_{No}(m,i)$. Specifically, local speech quality LSQ(m) is determined using the following equation $$LSQ(m) = \log\left[\sum_{i=1}^{N_c} ANR(m,i)R(m,i)\right] \qquad \text{equation (2)}$$

where $$R(m,i) = \frac{\log(1+P_{No}(m,i)}{\sum_{k=1}^{Nc}\log(1+P_{No}(m,k)} \qquad \text{equation (3)}$$

and k is a frequency index.

In step 240, overall speech quality SQ for speech signal s(t) is determined using local speech quality LSQ(m) and a log power $P_s(m)$ for frame m. Specifically, speech quality SQ is determined using the following equation $$SQ = L\{P_s(m)LSQ(m)\}_{m=1}^{T} = \left[\sum_{\substack{m=1\\ P_s>P_{th}}}^{T} P_s^{\lambda}(m)LSQ^{\lambda}(m)\right]^{1/\lambda} \qquad \text{equation (4)}$$

$$\text{where } P_s(m) = \log\left[\sum_{t\hat{I}m} s^2(t)\right],\ L \text{ is } L_p\text{-norm,}$$

T is the total number of frames in speech signal s(t), λ is any value, and $P_{th}$ is a threshold for distinguishing between audible signals and silence. In one embodiment, λ is preferably an odd integer value.

The output of articulatory analysis module 16 is an assessment of speech quality SQ over all frames m. That is, speech quality SQ is a speech quality assessment for speech signal s(t).

Although the present invention has been described in considerable detail with reference to certain embodiments, other versions are possible. Therefore, the spirit and scope of the present invention should not be limited to the description of the embodiments contained herein.

I claim:

1. A method of performing auditory-articulatory analysis comprising the steps of:

comparing an articulation power and a non-articulation power for a speech signal, wherein the articulation and non-articulation powers are powers associated with articulation and non-articulation frequencies of the speech signal; and assessing speech quality based on the comparison between the articulation and non-articulation powers.

2. The method of claim 1, wherein the articulation frequencies are approximately 2~12.5 Hz.

3. The method of claim 1, wherein the articulation frequencies correspond approximately to a speed of human articulation.

4. The method of claim 1, wherein the non-articulation frequencies are approximately greater than the articulation frequencies.

5. The method of claim 1, wherein the comparison between the articulation power and non-articulation power is a ratio between the articulation power and non-articulation power.

6. The method of claim 5, wherein the ratio includes a denominator and numerator, the numerator including the articulation power and a small constant, the denominator including the non-articulation power plus the small constant.

7. The method of claim 1, wherein the comparison between the articulation power and non-articulation power is a difference between the articulation power and non-articulation power.

8. The method of claim 1, wherein the step of assessing speech quality includes the step of:

determining a local speech quality using the comparison between the articulation and non-articulation powers.

9. The method of claim 8, wherein the local speech quality is further determined using a weighing factor based on a DC-component power.

10. The method of claim 9, wherein an overall speech quality is determined using the local speech quality.

11. The method of claim 10, wherein the overall speech quality is further determined using a log power $P_s$.

12. The method of claim 1, wherein an overall speech quality is determined using a log power $P_s$.

13. The method of claim 1, wherein the step of comparing includes the step of:

performing a Fourier transform on each of a plurality of envelopes obtained from a plurality of critical band signals.

14. The method of claim 1, wherein the step of comparing includes the step of:

filtering the speech signal to obtain a plurality of critical band signals.

15. The method of claim 14, wherein the step of comparing includes the step of:

performing an envelope analysis on the plurality of critical band signals to obtain a plurality of modulation spectrums.

16. The method of claim 15, wherein the step of comparing includes the step of:

performing a Fourier transform on each of the plurality of modulation spectrums.

* * * * *